US008840092B2

(12) United States Patent
Kumar et al.

(10) Patent No.: US 8,840,092 B2
(45) Date of Patent: Sep. 23, 2014

(54) CARBONATION APPARATUS AND METHOD FOR FORMING A CARBONATED BEVERAGE

(75) Inventors: Santhosh Kumar, Naperville, IL (US); Ted Jablonski, Palatine, IL (US); Jayateertha Malagi, Karnataka (IN); Servesh Adderi Ranganath, Karnataka (IN); Nishant Kulkarni, Karnataka (IN); Ravi Malavat, Karnataka (IN)

(73) Assignee: Cornelius, Inc., St. Paul, MN (US)

( * ) Notice: Subject to any disclaimer, the term of this patent is extended or adjusted under 35 U.S.C. 154(b) by 285 days.

(21) Appl. No.: 13/456,648

(22) Filed: Apr. 26, 2012

(65) Prior Publication Data

US 2013/0108760 A1 May 2, 2013

Related U.S. Application Data

(63) Continuation-in-part of application No. 13/337,397, filed on Dec. 27, 2011, which is a continuation-in-part of application No. 13/171,957, filed on Jun. 29, 2011.

(60) Provisional application No. 61/398,631, filed on Jun. 29, 2010.

(51) Int. Cl.
*B01F 3/04* (2006.01)

(52) U.S. Cl.
CPC ..... *B01F 3/04815* (2013.01); *B01F 3/04808* (2013.01); *B01F 3/04737* (2013.01); *Y10S 261/07* (2013.01); *Y10S 261/75* (2013.01)
USPC ..... 261/26; 261/27; 261/34.1; 261/76; 261/78.2; 261/DIG. 7; 261/DIG. 75; 426/477; 99/323.1

(58) Field of Classification Search
CPC .... B01F 3/04; B01F 3/04106; B01F 3/04099; B01F 3/04787; B01F 3/04808
USPC ..... 261/26, 27, 34.1, 76, 78.2, DIG. 7, 261/DIG. 75; 426/477; 99/323.1
See application file for complete search history.

(56) References Cited

U.S. PATENT DOCUMENTS 4,386,636 A 6/1983 Ellert
4,859,376 A * 8/1989 Hancock et al. ..... 261/35

(Continued)

FOREIGN PATENT DOCUMENTS

DE 10250707 5/2004
DE 202006002983 6/2006

(Continued)

OTHER PUBLICATIONS

International Search Report from corresponding PCT/U52011/042374 issued Feb. 24, 2012; 4 pgs.

(Continued)

*Primary Examiner* — Robert A Hopkins
(74) *Attorney, Agent, or Firm* — Andrus Intellectual Property Law, LLP

(57) ABSTRACT

An inline carbonation apparatus includes a fluid tube having an inner diameter. A water flow control module is connected to a water source. At least one water orifice is linked to the water flow control module and is attached at one end of the fluid tube. The water orifice includes a plurality of holes atomizing water passing therethrough. A carbon dioxide source is connected to a carbon dioxide valve. The carbon dioxide solenoid valve is connected to a carbon dioxide regulator that is coupled to a carbon dioxide orifice and attached to the fluid tube in a spaced relationship from the water orifice. The atomized water has a pressure less than the carbon dioxide such that carbon dioxide is absorbed into the water forming carbonated water having a specified volume of carbonation. The water control module regulates a water flow rate into the inline carbonation apparatus.

35 Claims, 9 Drawing Sheets

(56) References Cited

U.S. PATENT DOCUMENTS

| | | | | |
|---|---|---|---|---|
| 5,124,088 | A | 6/1992 | Stumphauzer | |
| 5,510,060 | A | 4/1996 | Knoll | |
| 5,842,600 | A | 12/1998 | Singleterry et al. | |
| 6,758,462 | B2 * | 7/2004 | Bellas et al. | 261/78.2 |
| 2006/0249536 | A1 | 11/2006 | Hartman et al. | |
| 2006/0288874 | A1 | 12/2006 | Ziesel | |

FOREIGN PATENT DOCUMENTS

| | | | |
|---|---|---|---|
| DE | 202007003204 | | 8/2007 |
| DE | 102008032369 | | 1/2010 |
| EP | 1295844 | A1 | 3/2003 |
| EP | 2070586 | | 6/2009 |
| FR | 2715581 | | 8/1995 |
| GB | 1274363 | | 5/1972 |
| GB | 2342594 | | 4/2000 |
| WO | 00-07707 | A1 | 2/2000 |
| WO | 01/81238 | A1 | 11/2001 |

OTHER PUBLICATIONS

International Search Report and Written Opinion for PCT/US2012044332 dated Sep. 18, 2012.

International Search Report and Written Opinion for PCT/US2012/044300 dated Sep. 18, 2012.

* cited by examiner

Fig-16
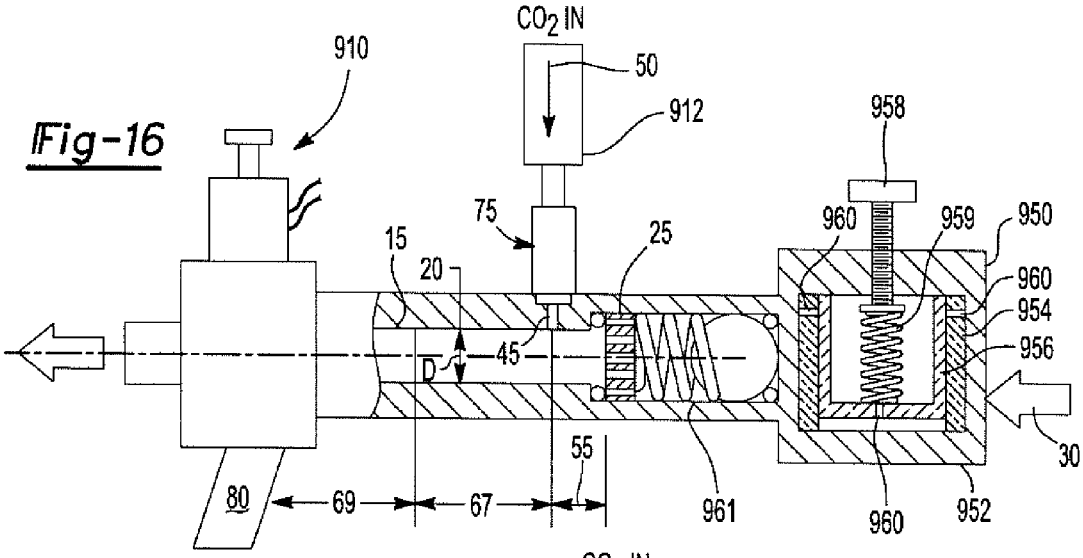
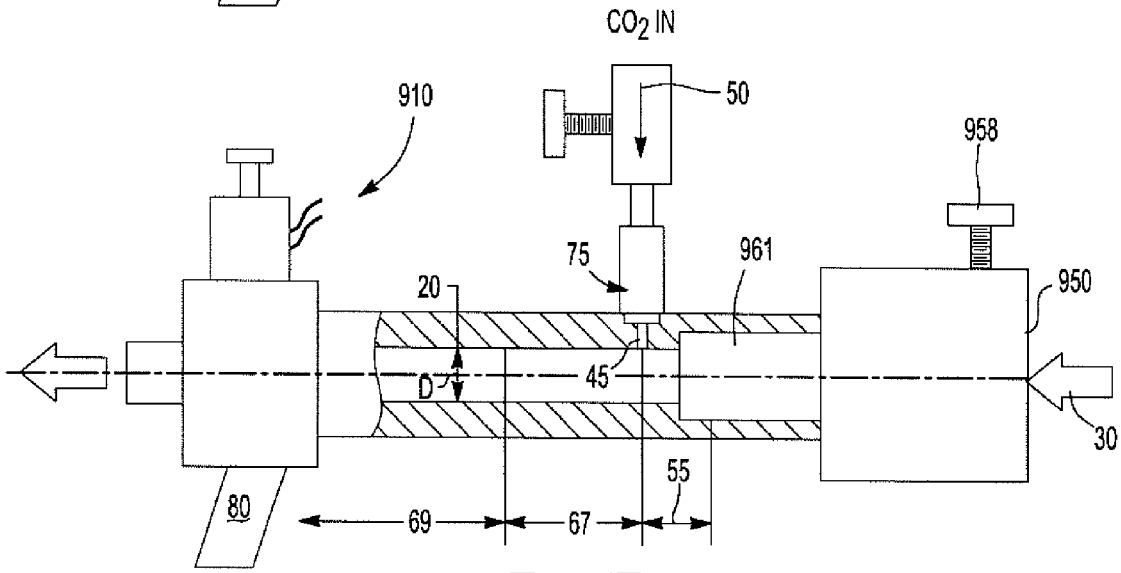
Fig-17
Fig-18
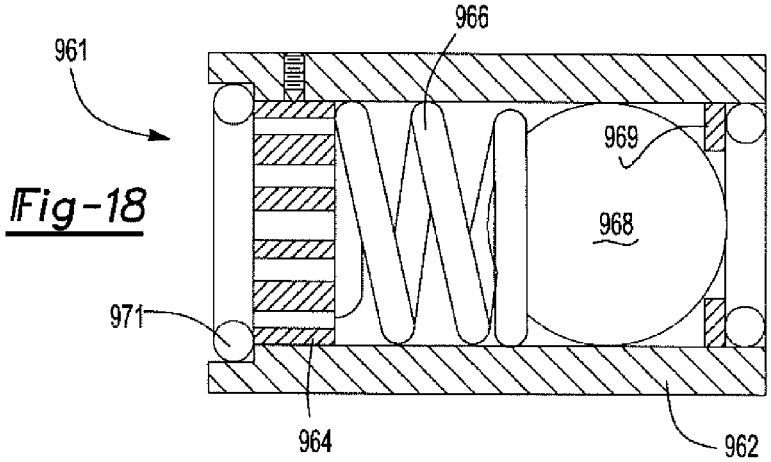

CARBONATION APPARATUS AND METHOD FOR FORMING A CARBONATED BEVERAGE

CROSS-REFERENCE TO RELATED APPLICATIONS

This application claims priority of U.S. Provisional Application No. 61/398,631 filed Jun. 29, 2010 and U.S. Utility application Ser. No. 13/171,957 filed Jun. 29, 2011, and Utility application Ser. No. 13/337,397 filed Dec. 27, 2011 which are incorporated herein by reference.

FIELD OF THE INVENTION

The invention relates to carbonation apparatus and a method for forming a carbonated beverage.

BACKGROUND OF THE INVENTION

Generally it is known to provide carbonated beverages that utilize carbonated water. The carbonated water is generally formed using a carbonator tank into which water under pressure is introduced into the tank with carbon dioxide also under pressure. The pressure of the contents of the vessel forces the carbon dioxide into the water forming a carbonated water. Typically such carbonator tanks are bulky and large and increase the manufacturing cost of a beverage dispensing system. Additionally, a large carbonation tank significantly increases the footprint or size of a drink dispenser. Further, large carbonation tanks may provide a failure mode for a carbonated beverage system requiring an expensive replacement of the component.

There is therefore a need in the art for an improved carbonation system and method that provides a carbonated beverage without the use of a large carbonator tank.

SUMMARY OF THE INVENTION

In one aspect, an inline carbonation apparatus includes a fluid tube having an inner diameter. A water flow control module is connected to a water source. At least one water orifice is linked to the water flow control module and is attached at one end of the fluid tube. The water orifice includes a plurality of holes atomizing water passing therethrough. A carbon dioxide source is connected to a carbon dioxide valve. The carbon dioxide solenoid valve is connected to a carbon dioxide regulator that is coupled to a carbon dioxide orifice and attached to the fluid tube in a spaced relationship from the water orifice. The atomized water has a pressure less than the carbon dioxide such that carbon dioxide is absorbed into the water forming carbonated water having a specified volume of carbonation. The water control module regulates a water flow rate into the inline carbonation apparatus.

In another aspect, an inline carbonation apparatus includes a fluid tube having an inner diameter. At least one water orifice is linked to a water source and is attached at one end of the fluid tube. The water orifice includes a plurality of holes atomizing water passing therethrough. A carbon dioxide source is connected to a carbon dioxide control module. The carbon dioxide control module is connected with a carbon dioxide orifice and attached to the fluid tube in a spaced relationship from the water orifice. The atomized water has a pressure less than the carbon dioxide such that carbon dioxide is absorbed into the water forming carbonated water having a specified volume of carbonation. The carbon dioxide control module regulates the flow of carbon dioxide into the inline carbonation apparatus.

In one aspect, an inline carbonation apparatus includes a fluid tube having an inner diameter. A water flow control module is connected to a water source. At least one water orifice is linked to the water flow control module and is attached at one end of the fluid tube. The water orifice includes a plurality of holes atomizing water passing therethrough. A carbon dioxide source is connected to a carbon dioxide control module. The carbon dioxide control module is connected with a carbon dioxide orifice and attached to the fluid tube in a spaced relationship from the water orifice. The atomized water has a pressure less than the carbon dioxide such that carbon dioxide is absorbed into the water forming carbonated water having a specified volume of carbonation. The water control module regulates a water flow rate into the inline carbonation apparatus and the carbon dioxide control module regulates the flow of carbon dioxide into the inline carbonation apparatus.

In a further aspect, there is disclosed a beverage dispensing apparatus including at least one inline carbonation apparatus having a fluid tube having an inner diameter. A water flow control module is connected to a water source. At least one water orifice is linked to the water flow control module and is attached at one end of the fluid tube. The water orifice includes a plurality of holes atomizing water passing therethrough. A carbon dioxide source is connected to a carbon dioxide regulator that is coupled to a carbon dioxide orifice and attached to the fluid tube in a spaced relationship from the water orifice. The atomized water has a pressure less than the carbon dioxide such that carbon dioxide is absorbed into the water forming carbonated water having a specified volume of carbonation. The water control module regulates a flow of water into the inline carbonation apparatus. The at least one inline carbonation apparatus is connected to a dispense valve.

In another aspect, there is disclosed a method of forming a carbonated beverage that includes the steps of providing a water supply and carbon dioxide supply linked to at least one inline carbonation apparatus having a fluid tube having an inner diameter; a water flow control module connected to the water supply, at least one water orifice linked to water control module and attached at one end of the fluid tube, the water orifice having a plurality of holes atomizing water passing therethrough; and a carbon dioxide source connected to a carbon dioxide control module, the carbon dioxide control module connected with a carbon dioxide orifice and attached to the fluid tube in a spaced relationship from the water orifice; and introducing water and carbon dioxide into the inline carbonation apparatus at a specified flow rate forming carbonated water having a specified volume of carbonation.

BRIEF DESCRIPTION OF THE DRAWINGS

FIG. 16 is a side schematic view of an inline carbonation apparatus including a water control module having a piston and sleeve, carbon dioxide control module and water orifice cartridge;

FIG. 17 a side schematic view of an inline carbonation apparatus including a water control module and water orifice cartridge;

FIG. 18 is a side schematic view of the water orifice cartridge showing the inner structure;

DETAILED DESCRIPTION OF THE PREFERRED EMBODIMENTS

Figure 1:
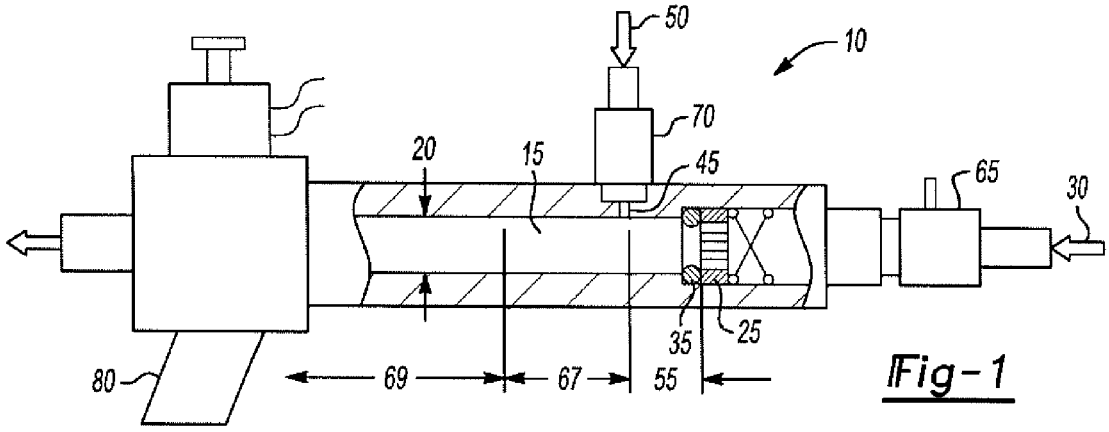
FIG. 1 is a schematic side view of an inline carbonation apparatus.

Referring to FIG. 1, there is shown an inline carbonation apparatus 10 that includes a fluid tube 15 having an inner diameter 20. At least one water orifice 25 is linked to a water source 30 and is attached at one end 35 of the fluid tube 15. The water orifice 25 may have a plurality of holes 40 that atomize water passing therethrough. A carbon dioxide orifice 45 is linked to a carbon dioxide source 50 and is attached to the fluid tube 15 in a spaced relationship from the water orifice 25. The atomized water exiting the water orifice 25 has a pressure that is less than the carbon dioxide such that carbon dioxide is absorbed into the water forming carbonated water having a specified volume of carbonation.

In one aspect, the carbon dioxide orifice 45 is spaced from the water orifice 25 a distance of from one quarter to three quarters of the diameter 20 of the fluid tube 15. This spacing defines a first free jet zone 55 within the inline carbonation apparatus 10. In one aspect, the plurality of holes 40 of the water orifice 25 may have a size ranging from 0.6 to 2.0 millimeters. Various numbers of holes 40 may be formed in the water orifice 25 to create the atomized jet of water.

The carbon dioxide orifice 45 also includes a plurality of holes 60 and may have a size ranging from 1 to 3 millimeters. Either of the water orifice 25 or the carbon dioxide orifice 45 may include a removable orifice plate such that various sized holes as well as various numbers of holes may be utilized in the water orifice 25 or carbon dioxide orifice 45. Alternatively, the water orifice 25 and carbon dioxide orifice 45 may have a fixed number of holes and have a fixed size. A second mixing zone 67 is defined by the carbon dioxide orifice 45 and extends a distance of from 1 to 6 times the inner diameter 20 of the fluid tube 15. The carbon dioxide is introduced into the atomized water in the mixing zone 67. A third pipe flow zone 69 starts at the end of the mixing zone 67 and transports the formed carbonated water through the carbonation apparatus 10.

As stated above, the atomized water exiting the water orifice 25 has a pressure less than the carbon dioxide such that carbon dioxide is absorbed into the water forming the carbonated water. In one aspect, a pressure difference between the atomized water and carbon dioxide is maintained from 5 to 20 psi forming carbonated water having from 2 to 3 volumes of carbonation. In another aspect, a pressure difference between the atomized water and carbon dioxide may be maintained from 30 to 40 psi forming carbonated water having from 3 to 4.5 volumes of carbonation.

As stated above, various volumes of carbonation may be specified by regulating the pressure drop of the water relative to the carbon dioxide. Additionally, water may be introduced into the water orifice 25 that has a pressure of from 80 to 150 psi with a carbon dioxide introduced into the carbon dioxide orifice 45 that has a pressure of from 50 to 120 psi. In this manner carbonated water having from 3 to 4.3 volumes of carbonation may be formed. In another aspect, water may be introduced into the water orifice 25 having a pressure of from 40 to 80 psi with a carbon dioxide introduced into the carbon dioxide orifice 45 having a pressure of from 20 to 60 psi. In this manner carbonated water having from 2 to 3 volumes of carbonation may be formed. Regulating the pressure of the incoming water and carbon dioxide and controlling a pressure drop of the water relative to the carbon dioxide allows for formation of various volume fractions of carbonated water. This allows the formation of beverages that have differing carbonation levels.

The inline carbonation apparatus 10 may include a water check valve 65 that is connected to the water supply 30 and to the water orifice 25 to prevent back flow of carbonated water into the water supply 30. Additionally, a carbon dioxide check valve 70 may be connected to the carbon dioxide supply 50 and to the carbon dioxide orifice 45. In one aspect, the carbon dioxide check valve may have a cracking pressure of less than 5 psi.

Figure 2:
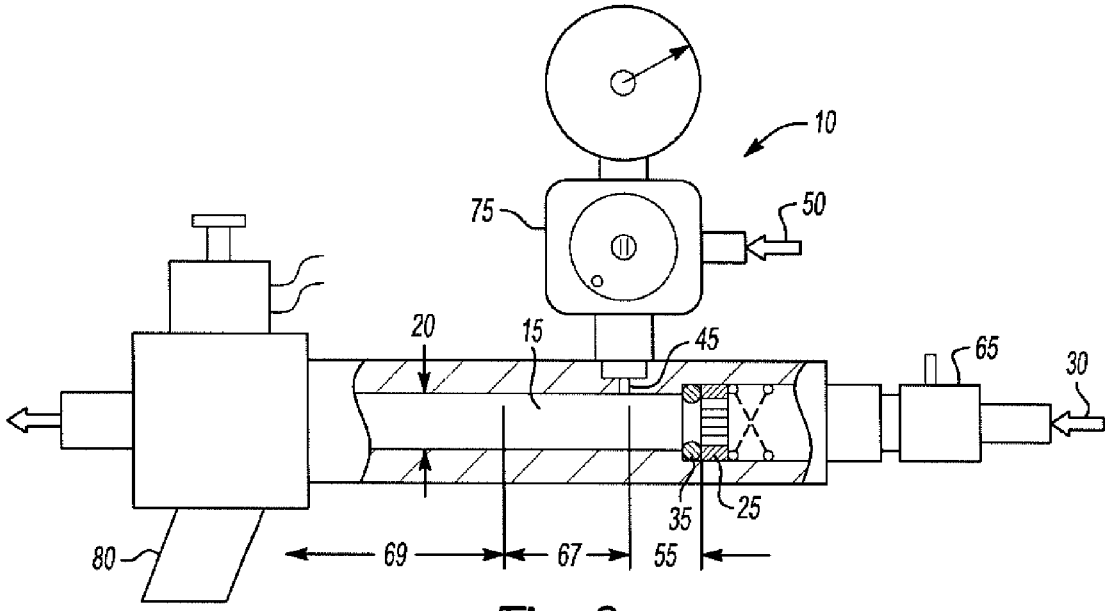
FIG. 2 is a side view schematic representation of an inline carbonation apparatus including a carbon dioxide pressure regulator.

Referring to FIG. 2, there is shown an embodiment of an inline carbonation apparatus 10 that includes a carbon dioxide regulator 75 directly mounted on the fluid tube 15. It should be realized that the carbon dioxide pressure may be regulated using various control mechanisms and systems as will be described in more detail below. Additionally, regulators may be positioned in alternate locations between the carbon dioxide orifice 45 and the source of carbon dioxide 50. In another aspect, the carbon dioxide regulator 75 may be integral with the carbon dioxide valve 70 or may be separate.

In another aspect, the inline carbonation apparatus 10 may include a solenoid valve 80 that is attached to the fluid tube 15. The solenoid valve 80 may prevent dispensing of a non carbonated water and links the fluid tube 15 to various dispensing valves 85. In one aspect, the solenoid valve may is attached to the fluid tube 15 and is positioned a distance 68 of from 4 to 12 times the diameter of the fluid tube 15 from the carbon dioxide orifice 50.

Figure 3:
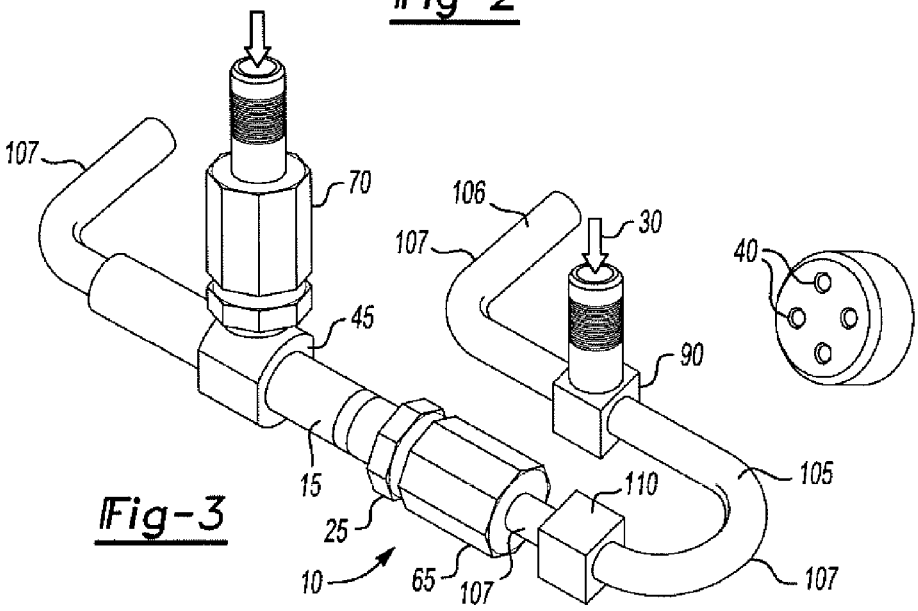
FIG. 3 is a partial perspective view of an inline carbonation apparatus including various attachment couplings and features.

The inline carbonation apparatus 10 may also include a splitting manifold 90 best seen in FIG. 3. The splitting manifold 90 may be connected to the water supply 30 and to the water check valve 65 to separate a non carbonated water source for dispensing. As can be seen in the figure, one leg or tube 100 from the splitting manifold 90 provides a non carbonated source of water while the other tube or connection 105 is linked to the inline carbonator apparatus 10. As can be seen in FIG. 3, multiple connections or tubes 107 may be included with the inline carbonation apparatus 10. In one aspect, various fittings and connections may be utilized. For example, quick disconnect features may be utilized for the check valves of the water orifice 25 and carbon dioxide orifice 45. Additionally, quick disconnect features for the water and tubing connections may also be included. Molded in barb features that connect to water and carbon dioxide tubing connections may also be utilized. Further, integrated solenoid valve mounting features may be included in inline carbonation apparatus 10. Such features and attachments allow the inline carbonation apparatus 10 to be easily assembled and disassembled allowing for quick repair and replacement.

In the embodiment depicted in FIG. 3, water is introduced into the splitting manifold 90 with one tube 100 providing a non carbonated water supply while the second tube 100 exits the splitting manifold 90 and connects with a pressure reducing or regulating valve 110. The pressure regulating valve 110 is coupled to a third tube 107 that is connected to a water check valve 65 having a cracking pressure of less than 5 psi. The water check valve 65 is coupled to a water orifice 25 that is connected to the fluid tube 15. A carbon dioxide check valve 70 is connected to the carbon dioxide orifice 45 that is linked with the fluid tube 15. The fluid tube 15 is further coupled to another tube section 107 that leads to a flow control or dispensing mechanism 85 for dispensing a carbonated beverage.

Figure 4:
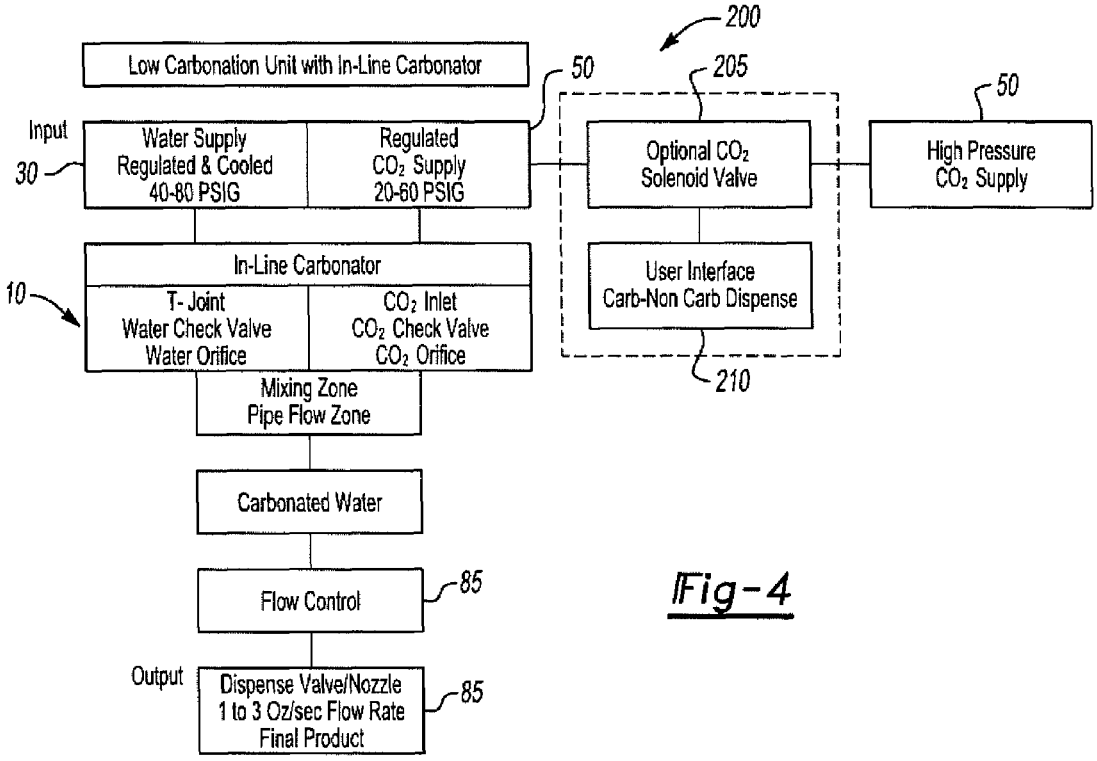
FIG. 4 is a block diagram of a beverage dispensing system that includes the inline carbonator and a $CO_2$ solenoid valve.
Figure 5:
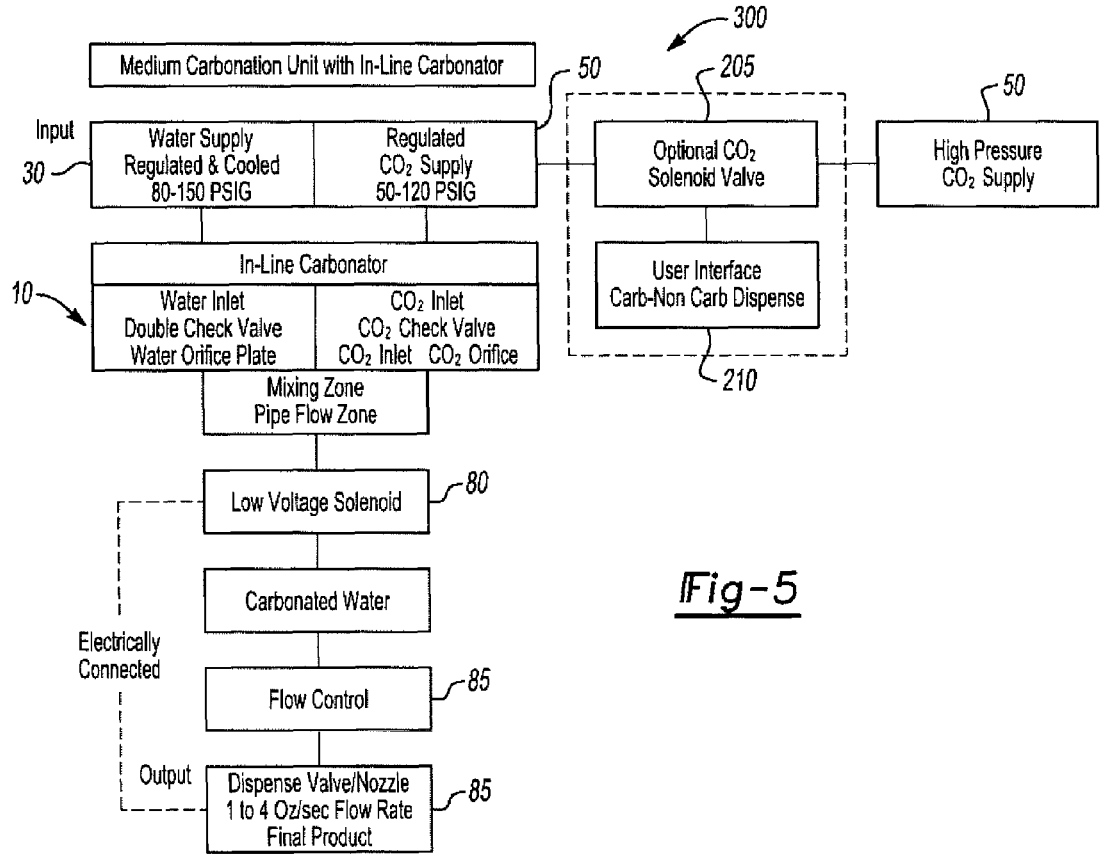
FIG. 5 is a block diagram of a beverage dispensing system including an inline carbonator having a $CO_2$ solenoid valve and a low voltage solenoid valve controlling dispensing of a carbonated beverage.

Referring to FIGS. 4 and 5, there are shown block diagrams for a beverage dispensing apparatus 200 that includes the inline carbonation apparatus 10. As shown in FIG. 4, a water supply 30 and carbon dioxide supply 50 are connected to the inline carbonation apparatus 10. A carbon dioxide valve 205 is connected to the carbon dioxide supply 50 and may be utilized to switch between carbonated and non carbonated water dispensed at the option of a user interface 210. The inline carbonation apparatus 10 produces a carbonated water which is sent to a flow control section 85 to dispense carbonated water at a specified flow rate to form a final dispensed beverage product. The flow control section 85 may include multiple valves or a single valve linked with a single inline carbonator 10 or multiple inline carbonators 10.

Referring to FIG. 5, there is shown a beverage dispensing apparatus 300 that includes the inline carbonation apparatus that is connected to a water supply 30 and a carbon dioxide supply 50. As with the previously described FIG. 4, a carbon dioxide valve 205 may be linked with a user interface 210 to supply both carbonated and non carbonated water for a beverage dispensing system. Additionally, a low voltage solenoid 80 may be included as part of a flow control system to regulate and dispense carbonated water to a dispensing valve or nozzle 85 to produce a final carbonated beverage product.

Figure 6:
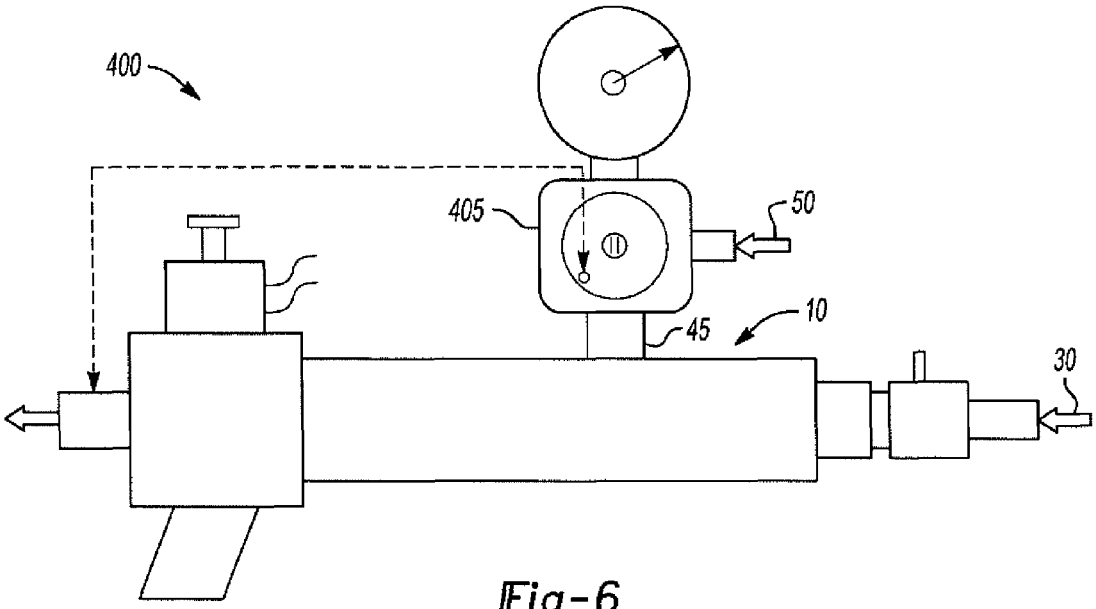
FIG. 6 is a side schematic view of an inline carbonation apparatus having a feedback control mechanism that dynamically adjusts $CO_2$ pressure.

Various feedback and control mechanisms may be utilized to control the carbon dioxide and water pressures introduced into the inline carbonation apparatus 10. Referring to FIG. 6, there is shown a feedback control mechanism 400 that may be utilized to dynamically adjust a carbon dioxide pressure to compensate for water pressure variations. As shown in the figure, a pressure signal of the carbonated water exiting the inline carbonator 10 is fed back into a differential pressure regulator 405 coupled to the carbon dioxide orifice 45. The differential pressure regulator 405 adjusts the diaphragm inside the regulator to dynamically change the water pressure on the other side of the diaphragm to maintain a constant carbon dioxide to water pressure differential.

Figure 7:
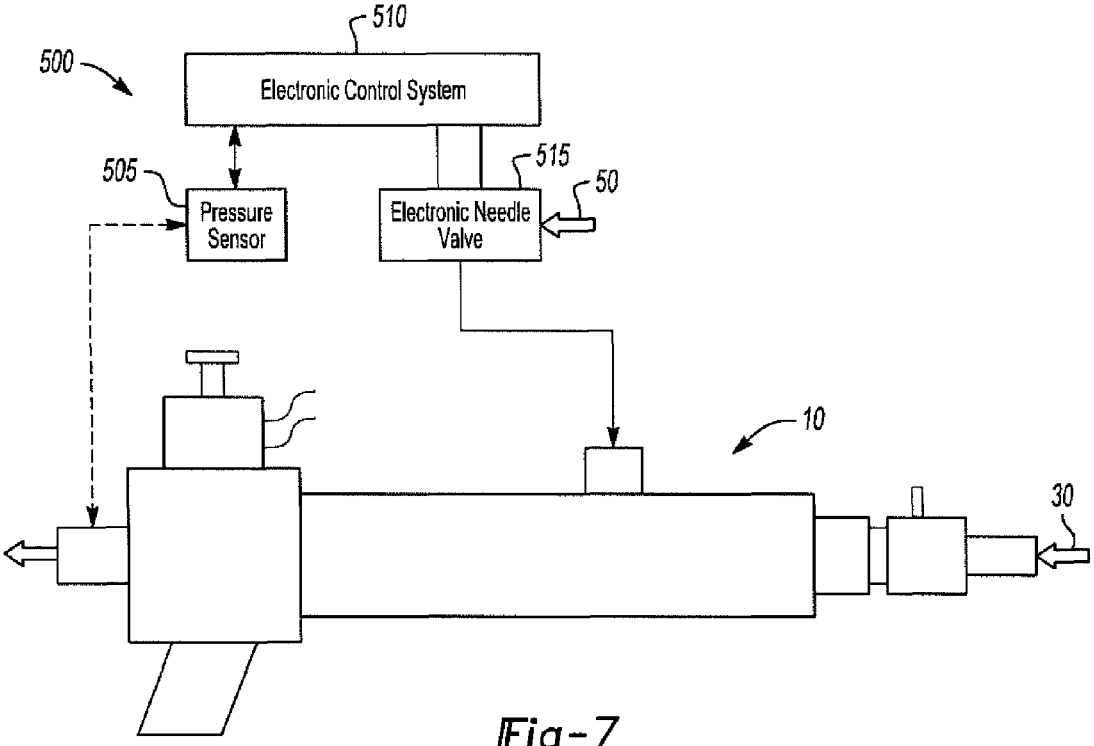
FIG. 7 is a side schematic view of an inline carbonation apparatus including an alternate feedback control system that includes a pressure sensor and logic that controls an electronic needle valve of the carbon dioxide.

Referring to FIG. 7, there is shown an alternate feedback and control mechanism 500 that utilizes a pressure sensor 505 and a control logic system 510 that is coupled to an electronic needle valve 515. The pressure of the carbonated water exiting the inline carbonator 10 is sensed and is continuously fed back into the control or electronic control system 510. The electronic control system 510 automatically adjusts the needle valve 515 to maintain a pressure differential between the atomized water and carbon dioxide introduced into the inline carbonator 10.

Figure 8:
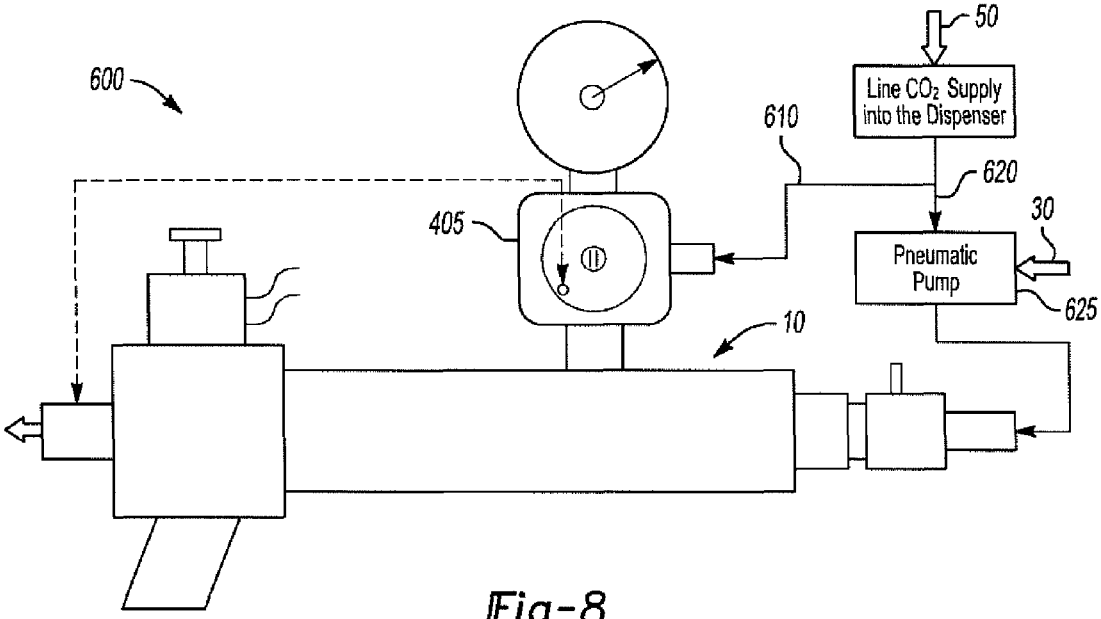
FIG. 8 is a side schematic view of an inline carbonation apparatus including a feedback control mechanism including a differential pressure mechanism that controls a pneumatic pump supplying water to the system.

Referring to FIG. 8, there is shown another feedback control mechanism 600 that may be utilized to dynamically adjust water pressure to accommodate carbon dioxide pressure variations. As can be seen in the figure, the feedback control mechanism 600 includes a differential pressure mechanism 405 that was previously described in FIG. 6. The incoming carbon dioxide is split into two branches 610, 620. One branch 610 feeds the differential pressure regulating mechanism 405 while the other branch 620 is utilized to drive a pneumatic pump 625 which in turn feeds water into the inline carbonator 10. A pressure variation in the incoming carbon dioxide will equally affect both the differential pressure regulating mechanism 405 and the pneumatic pump 625 pressure. Therefore when the pressure drops the pump 625 will have a lower incoming carbon dioxide pressure which will affect the water pressure. The lower water pressure coming into the inline carbonator 10 is sensed by the differential pressure regulating mechanism 405 and adjusts the carbon dioxide pressure into the carbon dioxide orifice 45.

Figure 9:
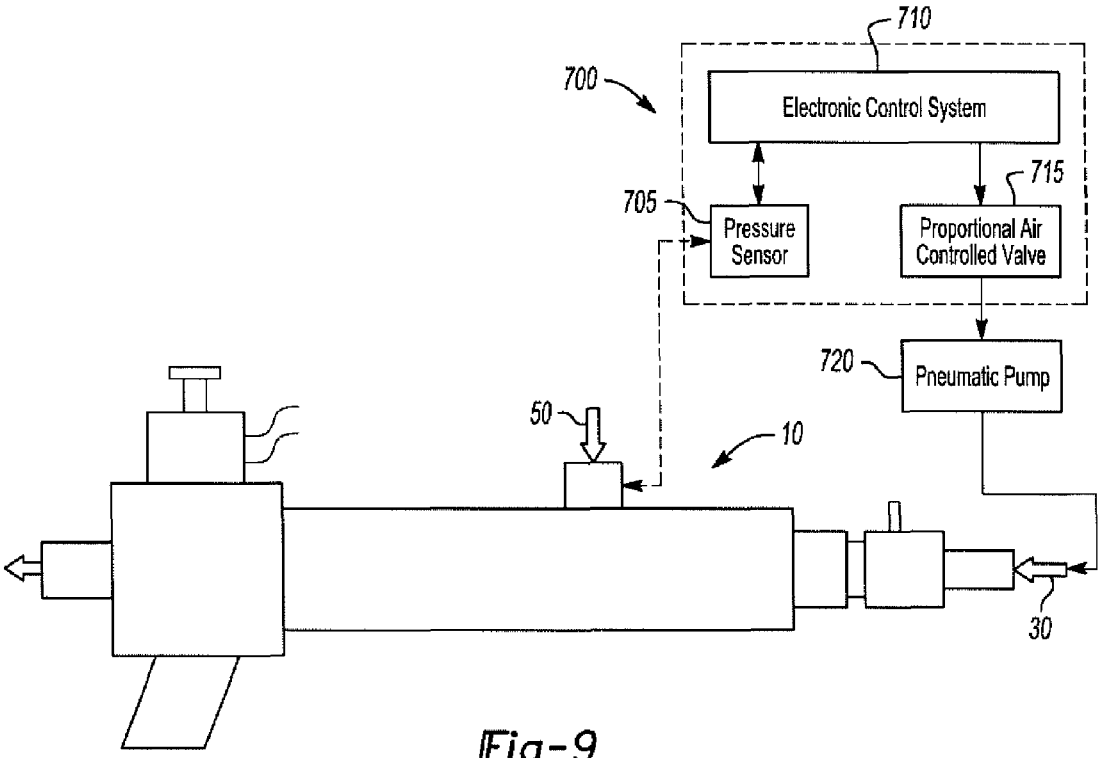
FIG. 9 is a side schematic view of an inline carbonation apparatus including a feedback control mechanism having a proportional air control valve that controls a pneumatic pump supplying water to the apparatus.

Referring to FIG. 9, there is shown another feedback and control mechanism. In the depicted embodiment, the control system 700 includes a pressure sensor 705 and control logic system 710 in conjunction with a proportional air control valve 715. The pressure of the carbon dioxide at the inline carbonator 10 is sensed continuously and is fed back into the electronic control system 710. The carbon dioxide pressure and control logic based in the electronic control system 710 adjusts a proportional air control valve 715 that dynamically adjusts the carbon dioxide pressure entering a pneumatic water pump 720. In this manner a constant carbon dioxide to water pressure differential as described above may be maintained.

A method of forming a carbonated beverage is also provided. The method includes the steps of providing a water supply 30 and carbon dioxide supply t50 hat is linked to an inline carbonation apparatus 10. The inline carbonation apparatus 10 includes a fluid tube 15 having an inner diameter 20. At least one water orifice 25 is linked to the water source 30 and is attached at one end of the fluid tube 15. The water orifice 25 has a plurality of holes 40 atomizing water passing therethrough. A carbon dioxide orifice 45 is linked to a carbon dioxide source 50 and is attached to the fluid tube 15 in a spaced relationship from the water orifice 25. The method includes introducing water and carbon dioxide into the inline carbonation apparatus 10 at a specified pressure forming carbonated water having a specified volume of carbonation.

In one aspect, the method includes atomizing water such that it has a pressure less than carbon dioxide introduced through the carbon dioxide orifice 45 such that carbon dioxide is absorbed into the water forming carbonated water having a specified volume of carbonation. In one aspect, the method includes spacing the water orifice 25 from the carbon dioxide orifice 45 a distance of from one quarter to three quarters of the diameter 20 of the fluid tube 15. Additionally, the method may include providing water and carbon dioxide at various pressures to form specific volume fractions of carbonation within a carbonated water. In one aspect, a pressure difference between the atomized water and carbon dioxide may be from 5 to 20 psi forming carbonated water having from 2 to 3 volumes of carbonation. Alternatively, a pressure difference between the atomized water and carbon dioxide may be maintained from 30 to 40 psi forming carbonated water having from 3 to 4.5 volumes of carbonation.

The method as stated above may also include supplying water and carbon dioxide at various pressures. In one aspect, the water orifice may have a pressure of from 80 to 150 psi and the carbon dioxide introduced into the carbon dioxide orifice may have a pressure of from 50 to 120 psi. Alternatively, the water orifice may have a pressure of from 40 to 80 psi and the carbon dioxide introduced into the carbon dioxide orifice may have a pressure of from 20 to 60 psi.

The method of the present invention may also include mixing carbonated water formed in the inline carbonation apparatus 10 in a desired ratio with a flavor and dispensing as a carbonated beverage. Various volume fractions of carbonated water may be utilized to form different beverages. Additionally, the method may include the step of bypassing the inline carbonator 10 such that non carbonated water is supplied and dispensed in a non carbonated beverage.

Figure 10:
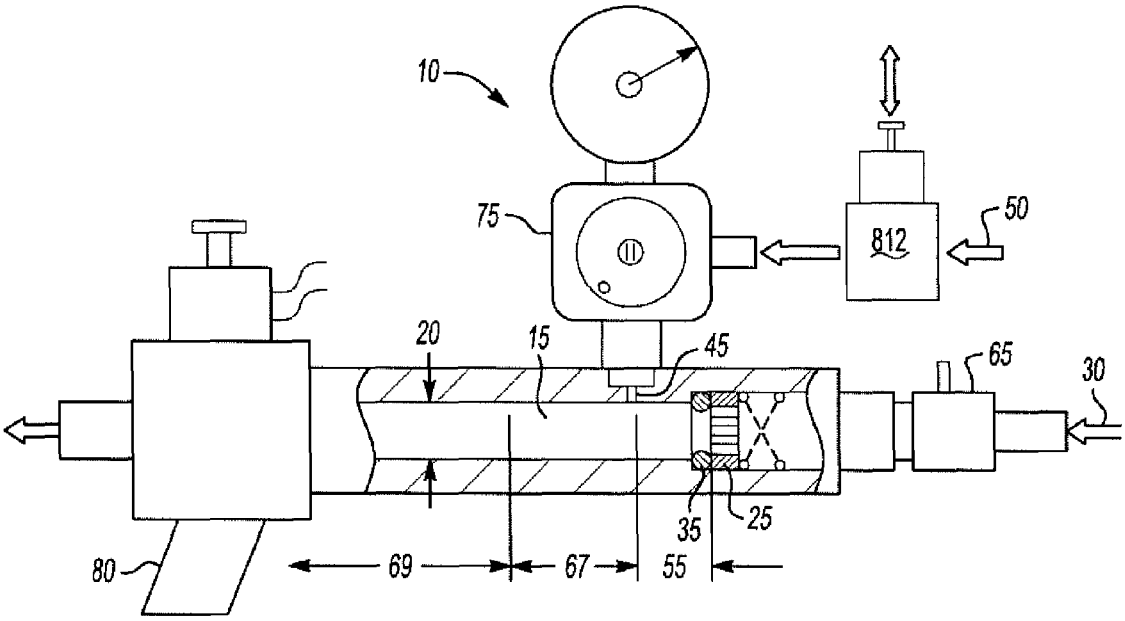
FIG. 10 is a schematic side view of an inline carbonation apparatus including a carbon dioxide solenoid valve connected to the regulator.

Referring to FIGS. 10-13, there is shown another alternative embodiment of an inline carbonation apparatus 810 and a beverage dispensing apparatus 822 in which a variable amount of carbonation may be provided. Referring to FIG. 10, there is shown an inline carbonation apparatus 810 that includes a fluid tube 15 having an inner diameter 20 and at least one water orifice 25 that is linked to a water source 30. The water orifice 25 is attached at one end of the fluid tube 15 and includes a plurality of holes that atomize water passing therethrough. A carbon dioxide source 50 is connected to a carbon dioxide solenoid valve 812. The carbon dioxide solenoid valve 812 is connected to a carbon dioxide regulator 75 that is coupled to a carbon dioxide orifice 45. The carbon dioxide orifice 45 is attached to the fluid tube 15 in a spaced relationship from the water orifice 25 such that the atomized water has a pressure less than the carbon dioxide such that carbon dioxide is absorbed into the water. In one aspect, the carbon dioxide solenoid valve 812 is opened and closed for a predetermined portion of a drink dispense time providing a volume of carbonated and non-carbonated fluid which upon mixing achieves a desired carbonation level.

In one aspect, the solenoid valve 812 may be a low voltage solenoid such as a 5, 12 or 24 volt DC solenoid assembled before the regulator and check valve 75 that feeds into the inline carbonator apparatus 810. The $CO_2$ or carbon dioxide solenoid valve 812 on or open time is provided by the flow controls, as will be discussed in more detail below.

In one aspect, for a given drink dispense time the solenoid valve 812 is turned on and off such that the valve opens and closes and supplies an amount of $CO_2$ for a definite amount of time. In this manner, carbonation is introduced into the water source 30 when the solenoid valve is open. The uncarbonated water produced when the solenoid valve 812 is closed mixes with the carbonated water to achieve a desired carbonation level. In one aspect, the flow control may be based on a relationship between the drink dispense size and time and the time that the solenoid $CO_2$ valve 812 is open or closed. In one aspect, a flow rate may be provided as an assumption such as for example 2.5 ounces per second. An increase or decrease in the drink flow rate will have a corresponding increase or decrease of the $CO_2$ solenoid 812 on time for a given or desired carbonation volume. As can be seen in the chart presented below, various volumes of carbonation may be specified with a corresponding $CO_2$ solenoid on time drink dispense time, and carbonated water volume. Various charts may be prepared for different flow rates and for different carbonation volumes and drink sizes.

Correlation chart—Carb water Flow rate: 2.5 oz/s

| | | Vol of CO2 | | | | |
|---|---|---|---|---|---|---|
| | | 1.5 (±0.25) | 2 (±0.25) | 2.5 (±0.25) | 3 (±0.25) | 3.5 (±0.25) |
| Carbonated Water Volume (oz) | Drink Dispense time (set) | CO2 solenoid ON time (sec) | | | | |
| 8 | 3.2 | 0.14 | 0.41 | 1.48 | 2.38 | 3.19 |
| 10 | 4.0 | 0.17 | 0.51 | 1.86 | 2.98 | 3.99 |
| 12 | 4.8 | 0.21 | 0.61 | 2.23 | 3.57 | 4.79 |
| 16 | 6.4 | 0.28 | 0.82 | 2.97 | 4.77 | 6.39 |
| 18 | 7.2 | 0.31 | 0.92 | 3.34 | 5.36 | 7.19 |
| 22 | 8.8 | 0.38 | 1.13 | 4.08 | 6.55 | 8.78 |
| 24 | 9.6 | 0.42 | 1.23 | 4.45 | 7.15 | 9.58 |
| 32 | 12.8 | 0.56 | 1.64 | 5.94 | 9.53 | 12.78 |

Alternatively, the solenoid valve 812 that is assembled with the inline carbonation apparatus 810 may be continuously pulsed or rapidly switched off and on to open and close the $CO_2$ solenoid valve 812 during the entire drink dispense time to provide a specified volume of carbonation. The pulsing of the solenoid valve 812 will cause a portion or specified amount of the water source introduced into the inline carbonation apparatus to become carbonated during the dispensing with a corresponding non-carbonated portion of water when the solenoid is closed. However, as described above the final or dispensed fluid will be carbonated to a specified volume due to the volumetric mixing of a carbonated and non-carbonated fluid. Again, various relationships such as that provided in the chart specified above may be utilized to control the solenoid valve 812 on time whether it be pulsed or on and off for a specified time.

Figure 11:
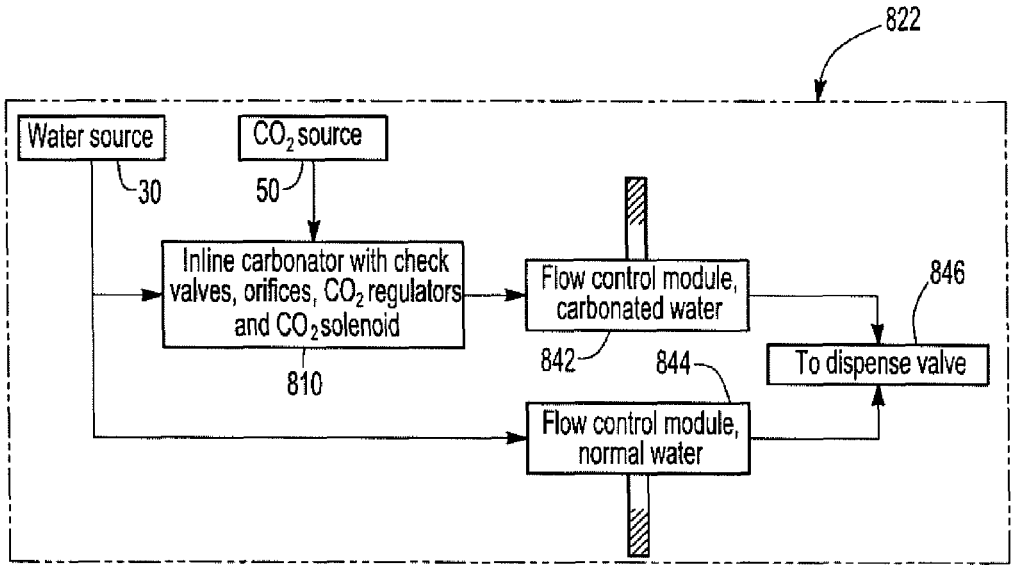
FIG. 11 is a block diagram of a beverage dispensing system including an inline carbonator having a $CO_2$ solenoid valve connected to the regulator and flow controls for water and a carbonated fluid linked to a dispense valve.

Referring to FIG. 11, there is shown an alternate embodiment of a beverage dispensing apparatus 822 that includes the inline carbonation apparatus 810 having a carbon dioxide solenoid valve 812 as described above. In one aspect, a water source 30 may be coupled to both the inline carbonation apparatus 810 and to a flow control module for water 844. Additionally, the inline carbonator 810 including the solenoid valve 812 may be coupled to a $CO_2$ source 50 as described above. A flow control for the carbonation 842 is coupled to the inline carbonation apparatus 810. Both the water and carbonation flow control modules 844, 842 or mechanisms are coupled to a dispensing or dispense valve 846. The inline carbonation apparatus 810 may be utilized to generate carbonated water for a desired carbonation level as described above. The carbonated water is then fed into the carbonation flow control module 842 with a flow rate that may be adjusted. The water source additionally sends fluid to the water control module 844 again which may be adjusted to various flow rates. In this manner, a defined portion of carbonated and non-carbonated fluid is dispensed through the dispense valve 846 to provide a fluid having a desired carbonation level. The ratio of carbonated to non-carbonated fluid in the final dispensed drink may be determined by a ratio of the flow rates.

Figure 12:
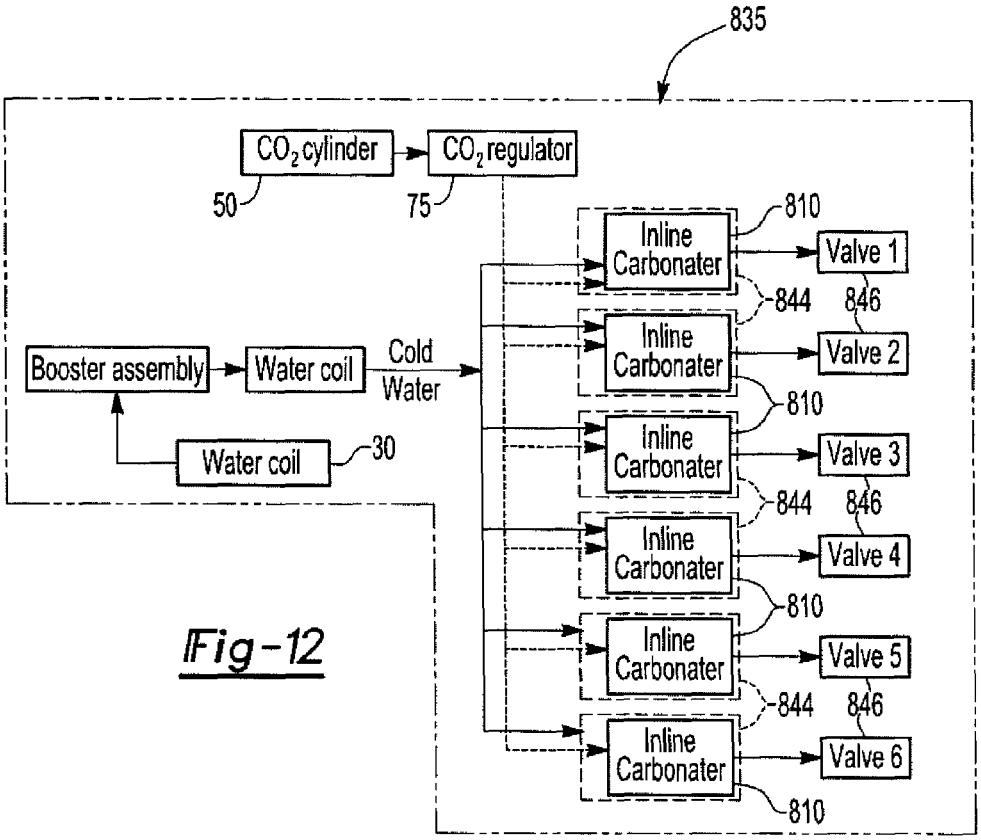
FIG. 12 is a block diagram of a beverage dispensing system including a plurality of inline carbonators having a $CO_2$ solenoid valve connected to the regulator and flow controls for water and a carbonated fluid linked to a multiple dispense valve.

Referring to FIG. 12, there is shown another beverage dispensing apparatus embodiment 832. In the depicted embodiment, a plurality of inline carbonation apparatus 810 is provided that each link to a dispensing valve 846. A water source and $CO_2$ source 30, 50 are coupled to each of the inline carbonation apparatus 810 that include the $CO_2$ or carbon dioxide solenoid valve 812 as described above. In one aspect, each of the plurality of inline carbonators 810 can be preset to a specific flow rate and carbonation volume. In this manner various carbonation levels may be provided in a single beverage dispensing apparatus 832 based on a predetermined volume of carbonation desired.

Figure 13:
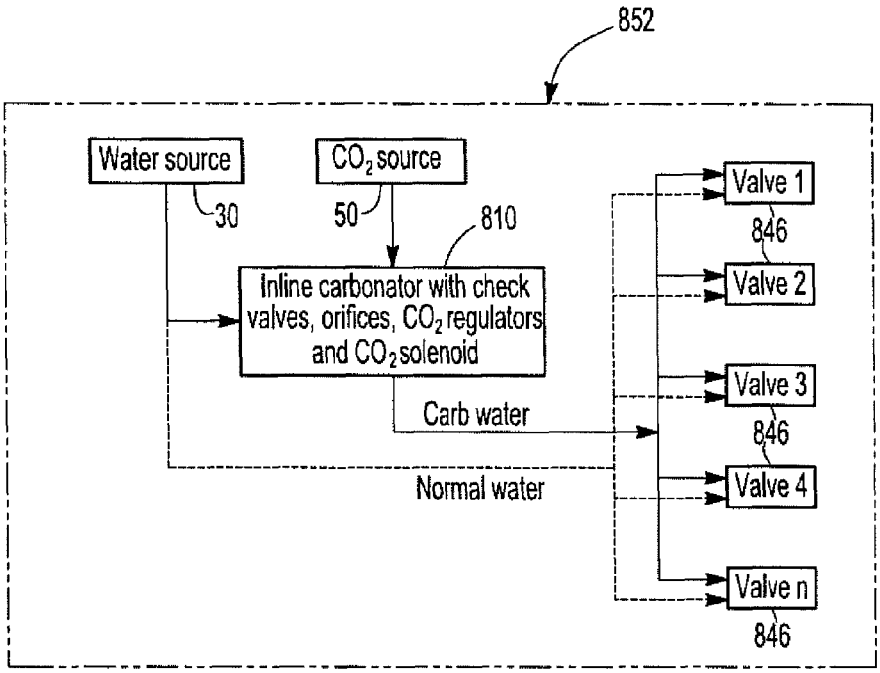
FIG. 13 is a block diagram of a beverage dispensing system including an inline carbonator having a $CO_2$ solenoid valve connected to the regulator and flow controls for water and a carbonated fluid linked to multiple dispense valves.

Referring to FIG. 13, there is shown another alternative embodiment of a beverage dispensing apparatus 852. In the depicted embodiment, a single inline carbonation apparatus 810 including the $CO_2$ solenoid valve 812 provides a source of carbonated fluid for multiple drink dispense valves 846. As can be seen in the depicted embodiment, a $CO_2$ source 50 and water source 30 are coupled to the inline carbonation apparatus 810. Additionally, the water source is coupled to the dispensing valves 846 with the use of a water control 844 and a carbonated flow control 842 that are connected to the individual dispense valves 846. In this manner, the inline carbonation apparatus 810 may be preset to a specific flow rate and carbonation volume that may be diluted and mixed with a specified volume from the water source to provide a fluid having a desired carbonation level to the various dispense valves.

A method of forming a carbonated beverage is also disclosed with reference to the embodiment of the inline carbonation apparatus disclosed in FIGS. 10-13. In one aspect, the method includes the steps of providing a water supply 30 and carbon dioxide supply 50 that are linked to at least one inline carbonation apparatus 810. The carbonation apparatus 810 includes a fluid tube 15 having an inner diameter 20 and at least one water orifice 25 linked to a water source 30 and attached at one end of the fluid tube 15. The water orifice 25 includes a plurality of holes 40 that atomize water passing therethrough. A carbon dioxide source 50 is connected to a carbon dioxide solenoid valve 812. The carbon dioxide solenoid valve 812 is connected to a carbon dioxide regulator 75 that is again coupled to a carbon dioxide orifice 45 and is attached to the fluid tube 15 in a spaced relationship from the water orifice 25. Water is then introduced with carbon dioxide into the inline carbonation apparatus 810 and the opening and closing of the carbon dioxide solenoid valve 812 provides a predetermined portion of carbonated fluid based on a drink dispense time such that a specified volume and level of carbonation is provided. As described above, the solenoid valve 812 may be opened and closed for a specified duration or may be pulsed during the drink dispense time to provide a fluid having a desired carbonation level. Additionally as provided above, the method includes providing a volume of carbonated and non-carbonated fluid which upon mixing achieves a desired carbonation level. Various numbers of inline carbonation apparatus 810 may be provided such that the method includes utilizing a single or multiple inline carbonation apparatus 810 coupled to various numbers of dispensing valves 846. Additionally, as described above the inline carbonation apparatus 810 may be linked with water flow controls 844 and carbonated flow controls 842 such that the water and carbonated flow controls adjust the volume of carbonated and non-carbonated fluid to provide a desired carbonation level.

Figure 14:
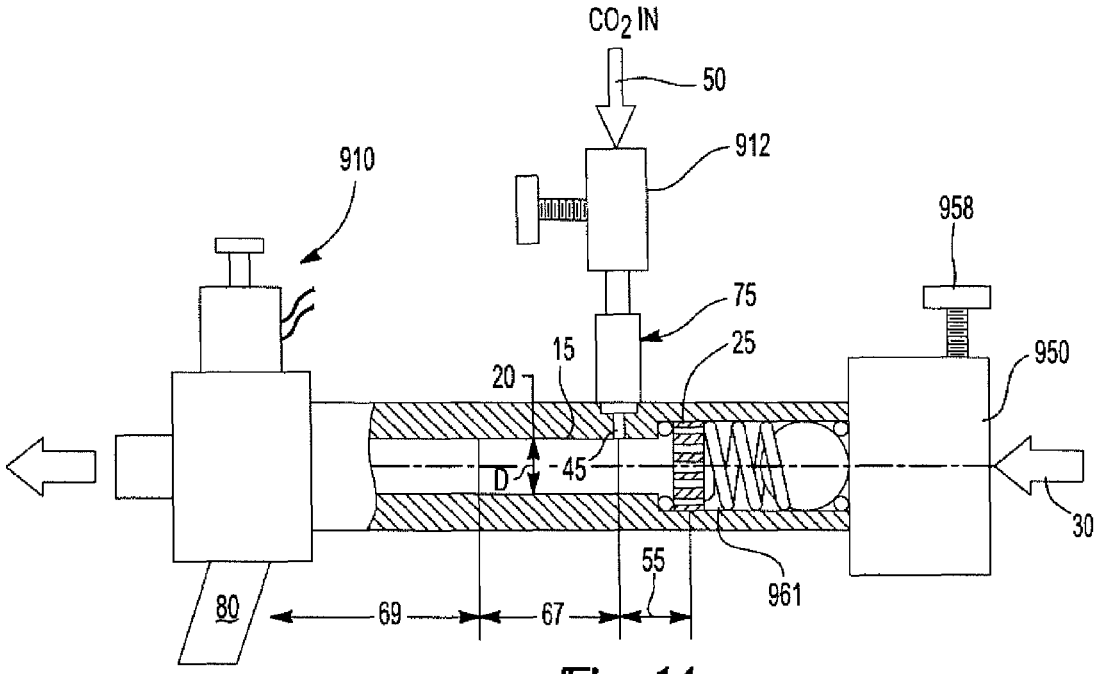
FIG. 14 is a side schematic view of an inline carbonation apparatus including a water control module, carbon dioxide control module and water orifice cartridge.

Referring to FIGS. 14-19, there is shown another alternative embodiment of an inline carbonation apparatus 910 and a beverage dispensing apparatus 922 in which a variable amount of carbonation may be provided. Referring to FIG. 14, there is shown an inline carbonation apparatus 910 that includes a fluid tube 15 having an inner diameter 20 and at least one water orifice 25 that is linked to a water control module 950 that is linked to a water source 30.

The water control module 950 may be a mechanical, electro-mechanical or electrical apparatus that regulates the flow of water. As best shown in FIG. 16, the water control module may include a body 952 having a sleeve 954 positioned therein. A piston 956 may be positioned within the sleeve 954 defining a water flow path. In one aspect, the piston 956 and sleeve 954 may be formed of a ceramic material. The water control module 950 may include an adjustment member 958 that is linked with the piston 956 for adjusting the piston 956 relative to the sleeve 954 to change a water flow path. In one aspect, the piston 956 and sleeve 954 may be interchangeable such that various pistons 956 and sleeves 954 can be inserted into the water control module 950 to provide varying water flow paths. The piston 956 and sleeve 954 may have one or more orifices 960 with a predetermined size which may be interchanged to achieve various outlet flow rates.

A biasing member 959 may be connected to the piston 956 and adjustment member 958 biasing the piston 956 relative to the sleeve 954. The biasing member 959 may act to compress or decompress the piston 956 against an inlet water pressure to adjust the outlet flow area maintaining a constant flow irrespective of an inlet pressure variation. Movement of the adjustment member 958 adjusts a compression of the biasing member 959 to modify the response of the biasing member 959 against the inlet water pressure.

The water control module 950 is connected to a water orifice 25 that is attached at one end of the fluid tube 15 and includes a plurality of holes that atomize water passing therethrough. The water orifice 25 may be as previously described above or may be a water orifice cartridge 961 as best shown in FIG. 18.

As shown in FIG. 18, the water orifice cartridge 961 may include a hollow body 962 that includes a water orifice plate 964 attached therein. The water orifice plate 964 includes a plurality of holes as described above. The water orifice cartridge 961 also includes a spring 966 and check valve 968 positioned therein preventing back flow of water. The water orifice cartridge 961 also includes a stop 969 formed therein controlling a position of the check valve 968. O-rings 971 may be provided in grooves formed in the body 962 sealing the cartridge 961 relative to the fluid tube 15. In one aspect, the cartridge 961 may be easily interchanged and may have various sized water orifice plates 964 to allow easy adjustment of flow parameters of water in the inline carbonation apparatus 910.

Figure 15:
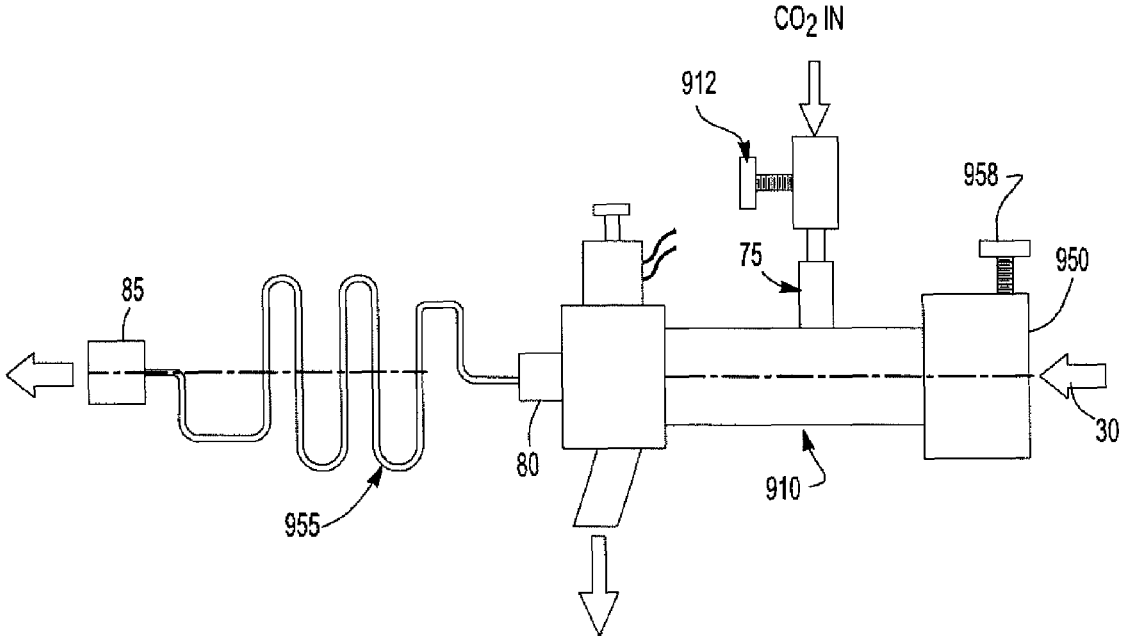
FIG. 15 is a side schematic view of an inline carbonation apparatus including a water control module, carbon dioxide control module connected with a chilling circuit and dispense valve.

Referring to FIG. 15, a carbon dioxide source 50 is connected to a carbon dioxide control module 912. The carbon dioxide control module may be connected to a carbon dioxide regulator 75 that is coupled to a carbon dioxide orifice 45. The carbon dioxide orifice 45 is attached to the fluid tube 15 in a spaced relationship from the water orifice 25 such that the atomized water has a pressure less than the carbon dioxide such that carbon dioxide is absorbed into the water. In one aspect, the carbon dioxide control module 912 regulates flow rate of carbon dioxide to achieve a desired carbonation level.

Referring to FIG. 15 there is shown an inline carbonation apparatus 910 that is connected to a chilling circuit 955 connected to a dispensing valve 85. In one aspect, the inline carbonation apparatus 910 may include a solenoid valve 80 that is attached to the fluid tube 15. The solenoid valve 80 may prevent dispensing of a non carbonated water, reduces carbon dioxide gas pockets in the water steam and allows switching on and off the carbonated water supply in real time when connected to a dispense valve having various electrical or mechanical flow adjustment structures.

In one aspect the chilling circuit 955 allows feeding water at ambient temperature into the inline carbonation apparatus instead of chilled water. Additionally, by running pre-carbonated water through the chilling circuit absorption and retention of carbon dioxide in the fluid may be improved due to a higher residence time.

Figure 19:
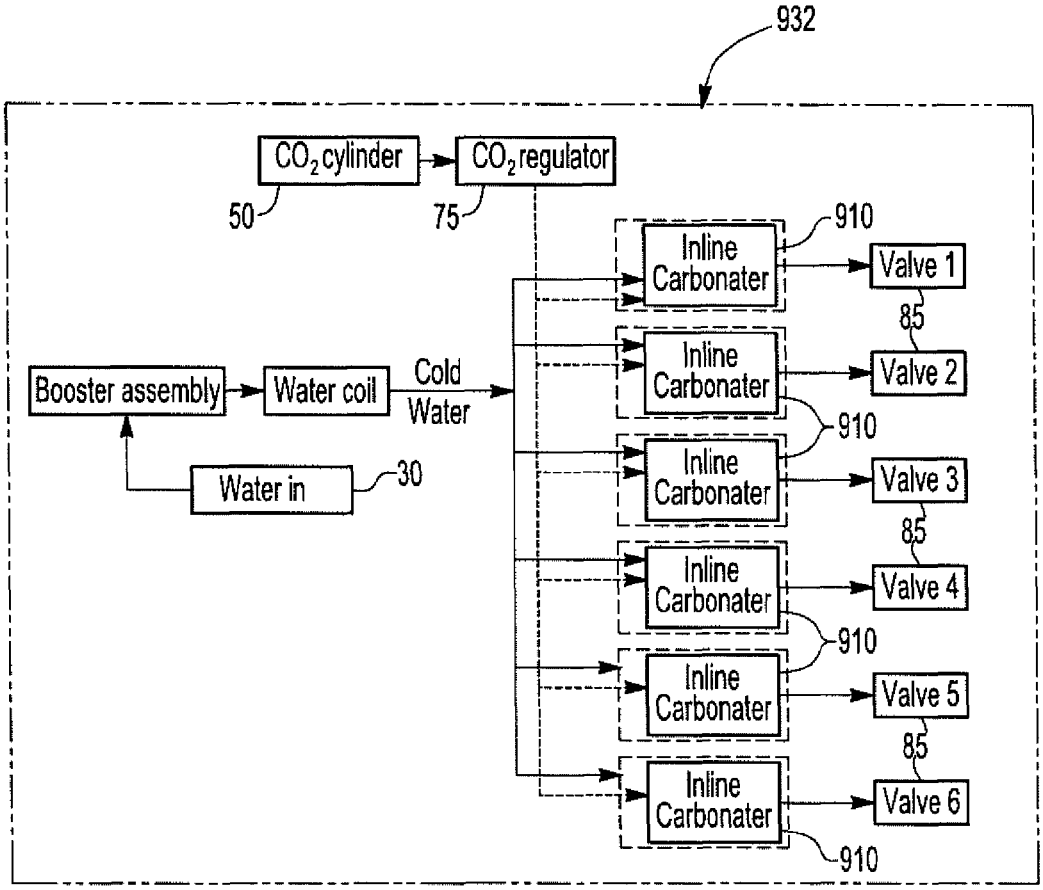
FIG. 19 is a block diagram of a beverage dispensing system including a plurality of inline carbonators having a water control module and carbon dioxide control module.

Referring to FIG. 19, there is shown another beverage dispensing apparatus embodiment 932. In the depicted embodiment, a plurality of inline carbonation apparatus 910 is provided that each link to a dispensing valve 85. A water source and $CO_2$ source 30, 50 are coupled to each of the inline carbonation apparatus 910 that include the $CO_2$ or carbon dioxide control module 912 and water control module 950 as described above. In one aspect, each of the plurality of inline carbonators 910 can be preset to a specific flow rate and carbonation volume. In this manner various carbonation levels may be provided in a single beverage dispensing apparatus 932 based on a predetermined volume of carbonation desired. It should be realized that a single inline carbonation apparatus 910 including the carbon dioxide control module 912 and water control module 950 may provide a source of carbonated fluid for multiple drink dispense valves 85.

A method of forming a carbonated beverage is also disclosed with reference to the embodiment of the inline carbonation apparatus disclosed in FIGS. 14-19. In one aspect, the method includes the steps of providing a water supply 30 and carbon dioxide supply 50 that are linked to at least one inline carbonation apparatus 910. The carbonation apparatus 910 includes a fluid tube 15 having an inner diameter 20, a water flow control module 950 connected to the water supply 30 and at least one water orifice 25 linked to the water flow control module 950 and attached at one end of the fluid tube 15. The water orifice 25 includes a plurality of holes 40 that atomize water passing therethrough. A carbon dioxide source 50 is connected to a carbon dioxide control module 912. The carbon dioxide control module 912 is connected with a carbon dioxide orifice 45 and is attached to the fluid tube 15 in a spaced relationship from the water orifice 25. Water is then introduced with carbon dioxide into the inline carbonation apparatus 910 at a specified flow rate forming carbonated water having a specified volume of carbonation. Various numbers of inline carbonation apparatus 910 may be provided such that the method includes utilizing a single or multiple inline carbonation apparatus 910 coupled to various numbers of dispensing valves 85.

The invention claimed is:

1. An inline carbonation apparatus comprising:

a fluid tube having an inner diameter;

a water flow control module connected to a water source;

at least one water orifice linked to the water flow control module and attached at one end of the fluid tube, the water orifice having a plurality of holes atomizing water passing therethrough; and a carbon dioxide source connected to a carbon dioxide valve, the carbon dioxide valve connected to a carbon dioxide regulator that is coupled to a carbon dioxide orifice and attached to the fluid tube in a space relationship from the water orifice, wherein the atomized water has a pressure less than the carbon dioxide such that carbon dioxide is absorbed into the water forming carbonated water having a specified volume of carbonation and wherein the water control module regulates a water flow rate;

wherein the at least one water orifice includes a water orifice cartridge attached to the fluid tube; and wherein the water orifice cartridge includes a hollow body having a water orifice plate attached therein.

2. The inline carbonation apparatus of claim 1 wherein the water orifice cartridge includes a spring and check valve positioned therein preventing back flow of water.

3. The inline carbonation apparatus of claim 2 wherein the water orifice cartridge includes a stop formed therein controlling a position of the check valve.

4. An inline carbonation apparatus comprising:

a fluid tube having an inner diameter;

a water flow control module connected to a water source;

at least one water orifice linked to the water flow control module and attached at one end of the fluid tube, the water orifice having a plurality of holes atomizing water passing therethrough; and a carbon dioxide source connected to a carbon dioxide valve, the carbon dioxide valve connected to a carbon dioxide regulator that is coupled to a carbon dioxide orifice and attached to the fluid tube in a spaced relationship form the water orifice, wherein the atomized water has a pressure less than the carbon dioxide such that the carbon dioxide is absorbed into the water forming carbonated water having a specified volume of carbonation and wherein the water control module regulates a water flow rate;

wherein the at least one water orifice includes a water orifice cartridge attached to the fluid tube;

wherein the water orifice cartridge includes a hollow body having a water orifice plate attached therein; and wherein the water orifice cartridge includes O-rings positioned therein sealing with the fluid tube.

5. An inline carbonation apparatus comprising:

a fluid tube having an inner diameter;

a water flow control module connected to a water source;

at least one water orifice linked to the water flow control module and attached at one end of the fluid tube, the water orifice having a plurality of holes atomizing water passing therethrough;

a carbon dioxide source connected to a carbon dioxide valve, the carbon dioxide valve connected to a carbon dioxide regulator that is coupled to a carbon dioxide orifice and attached to the fluid tube in a spaced relationship from the water orifice, wherein the atomized water has a pressure less than the carbon dioxide such that carbon dioxide is absorbed into the water forming carbonated water having a specified volume of carbonation and wherein the water control module regulates a water flow rate; and a solenoid valve attached to the fluid tube, the solenoid valve preventing dispensing of non carbonated water.

6. The inline carbonation apparatus of claim 5 wherein the water flow control module includes a body having a sleeve positioned therein and a piston positioned within the sleeve defining a water flow path.

7. The inline carbonation apparatus of claim 6 including an adjustment member linked with the piston.

8. The inline carbonation apparatus of claim 7 including a biasing member connected to the piston and adjustment member biasing the piston relative to the sleeve.

9. The inline carbonation apparatus of claim 6 wherein the piston and sleeve are formed of ceramic material.

10. The inline carbonation apparatus of claim 5 including a control and feedback system linked with the water control module controlling a pressure and volume of the water introduced into the inline carbonation apparatus.

11. The inline carbonation apparatus of claim 5 including a carbon dioxide control module linked to the carbon dioxide source, the carbon dioxide control module regulating a carbon dioxide flow rate.

12. The inline carbonation apparatus of claim 11 including a control and feedback system linked with the carbon dioxide control module controlling a pressure and volume of the carbon dioxide introduced into the inline carbonation apparatus.

13. The inline carbonation apparatus of claim 11 wherein the carbon dioxide control module regulates an amount of carbon dioxide adjusting a dispense flow appearance of a carbonated beverage.

14. The inline carbonation apparatus of claim 5 wherein the solenoid valve is connected to a chilling circuit coupled to a dispensing valve.

15. A beverage dispensing apparatus comprising:

at least one inline carbonation apparatus having;

a fluid tube having an inner diameter;

a water flow control module connected to a water source;

at least one water orifice linked to the water flow control module and attached at one end of the fluid tube, the water orifice having a plurality of holes atomizing water passing through;

a carbon dioxide source connected to a carbon dioxide regulator that is coupled to a carbon dioxide orifice and attached to the fluid tube in a spaced relationship form the water orifice, wherein the atomized water has a pressure less than the carbon dioxide such that carbon dioxide is absorbed into the water forming carbonated water having a specified volume of carbonation, wherein the water control module regulates a water flow rate; at least one dispense valve connected to at least one inline carbonation apparatus; and a solenoid valve attached to the fluid tube, the solenoid valve preventing dispensing of non-carbonated water.

16. The beverage dispensing apparatus of claim 15 wherein a single inline carbonation apparatus feeds carbonated water to multiple dispensing valves.

17. The beverage dispensing apparatus of claim 15 wherein a single inline carbonation apparatus feeds carbonated water to a dispensing valve.

18. The beverage dispensing apparatus of claim 15 including a plurality of inline carbonation apparatuses, each of the inline carbonation apparatuses including a water flow control and a carbonated flow control connected to individual dispense valves.

19. The beverage dispensing apparatus of claim 15 including a control and feedback system linked with the water control module controlling a pressure and volume of the water introduced into the inline carbonation apparatus.

20. The beverage dispensing apparatus of claim 15 including a carbon dioxide control module linked to the carbon dioxide source, the carbon dioxide control module regulating a carbon dioxide flow rate.

21. The beverage dispensing apparatus of claim 20 including a control and feedback system linked with the carbon dioxide control module controlling a pressure and volume of the carbon dioxide introduced into the inline carbonation apparatus.

22. The beverage dispensing apparatus of claim 15 wherein the at least one water orifice includes a water orifice cartridge attached to the fluid tube.

23. An inline carbonation apparatus comprising:

a fluid conduit having an upstream end, a downstream end, and an inner diameter;

a water source configured to supply a steam of water to the upstream end;

wherein the fluid conduit has a water orifice through which the stream of water passes, the water orifice defining a plurality of holes that are configured to atomize the stream of water;

carbon dioxide source that is configured to introduce a specified volume of carbon dioxide into the atomized stream of water via a carbon dioxide orifice that is located downstream of the water orifice;

a carbon dioxide regulator that is configured to regulate the introduction of the specified volume of carbon dioxide into the atomized stream of water;

wherein the water orifice is configured to cause the atomized stream of water to have a pressure that is less than a pressure of the carbon dioxide so that the carbon dioxide is adsorbed into the atomized stream of water and thereby produces a carbonated stream of water having a predetermined volume of carbonation; and a water control module that is configured to regulate flow of water from the water source to the upstream end of the conduit, wherein the water control module comprises a piston and an interchangeable set of sleeves, the interchangeable set of sleeves each causing different flow rates of water in to the upstream end of the conduit.

24. The apparatus according to claim 23, wherein each sleeve in die set of sleeves has an orifice that is differently sized than the orifice in the other sleeves in the set of sleeves.

25. The apparatus according to claim 24, wherein the piston and sleeve are formed of ceramic material.

26. The apparatus according to claim 23, comprising an adjustment member connected to the sleeve, wherein the adjustment member is configured to adjust the position of the piston with respect to the sleeve.

27. The apparatus according to claim 26, comprising a spring configured to bias the piston with respect to the sleeve.

28. The apparatus according to claim 27, wherein the spring is configured to compress or decompress the piston against an inlet water pressure from the water source to thereby adjust an outlet flow area and maintain a constant flow from the water control module, regardless of variations in the inlet water pressure.

29. An inline carbonation apparatus comprising;

a fluid conduit having an upstream end, a downstream end, and an inner diameter;

a water source configured to supply a steam of water to the upstream end;

wherein the fluid conduit has a water orifice through which the stream of water passes, the water orifice defining a plurality of holes that are configured to atomize the stream of water;

a carbon dioxide source that is configured to introduce a specified volume of carbon dioxide into the atomized stream of water via a carbon dioxide orifice that is located downstream of the water orifice;

a carbon dioxide regulator that is configured to regulate the introduction of the specified volume of carbon dioxide into the atomized stream of water;

wherein the water orifice is configured to cause the atomized stream of water to have a pressure that is less than a pressure of carbon dioxide so that the carbon dioxide is adsorbed into the atomized stream of water and thereby produces a carbonated stream of water having a predetermined volume of carbonation; and a water orifice cartridge attached to the fluid conduit and forming the water orifice, wherein the water orifice cartridge comprises a hollow body haying a water orifice plate attached therein, wherein the water orifice plate defines the plurality of holes that are configured to atomize the stream of water.

30. The apparatus according to claim 29, wherein the water orifice cartridge further comprises a check valve configured to prevent backflow of water.

31. The apparatus according to claim 30, wherein the water orifice cartridge further comprises a spring that biases the check valve and a. stop that is configured to control positioning of the check valve.

32. The apparatus according to claim 31, further comprising O-rings disposed in grooves on the body, the O-rings configured to seal the cartridge relative to the fluid conduit.

33. The apparatus according to claim 29, further comprising a plurality of water orifice cartridges, each configured to attach to the fluid conduit and form the water orifice, each having a hollow body and a water orifice plate therein, wherein the water orifice plate defines the plurality of holes, wherein the plurality of holes of each water orifice cartridges are configured differently to provide different flow parameters of the water.

34. An inline carbonation apparatus comprising:

a fluid conduit having an upstream end, a downstream end, and an inner diameter;

a water source configured to supply a steam of water to the upstream end;

wherein the fluid conduit has a water orifice through which the stream of water passes, the water orifice defining a plurality of holes that are configured to atomize the stream of water; and a carbon dioxide source that is configured to introduce a specified volume of carbon dioxide into the atomized stream of water via a carbon dioxide orifice that is located downstream of the water orifice;

a carbon dioxide regulator that is configured to regulate the introduction of the specified volume of carbon dioxide into the atomized stream of water;

wherein the water orifice is configured to cause the atomized stream of water to have a pressure that is less than a pressure of the carbon dioxide so that the of carbon dioxide is adsorbed into the atomized stream of water and thereby produces a carbonated stream of water having a predetermined volume of carbonation;

a dispenser valve that dispensing the carbonated stream of water; and a solenoid valve located downstream of the carbon dioxide orifice and upstream of the dispenser valve, wherein the solenoid valve is configured to prevent dispensing of non carbonated water, reduce carbon dioxide gas pockets in the carbonated stream of water, and allow switching on and off of the supply of the carbonated stream of water to the dispenser valve.

35. The apparatus according to claim 34, comprising a chilling circuit connected to the fluid conduit and configured to receive the carbonated stream of water.

* * * * *